US010765931B2

(12) United States Patent
Drake

(10) Patent No.: US 10,765,931 B2
(45) Date of Patent: Sep. 8, 2020

(54) ORIENTATION DEPENDENT TOKEN AND METHOD FOR PLAYING A GAME THEREWITH

(71) Applicant: Tetra Entertainment, LLC, Labadie, MO (US)

(72) Inventor: Daniel James Drake, University City, MO (US)

(73) Assignee: Tetra Entertainment, LLC, Labadie, MO (US)

( * ) Notice: Subject to any disclaimer, the term of this patent is extended or adjusted under 35 U.S.C. 154(b) by 0 days.

(21) Appl. No.: 16/505,205

(22) Filed: Jul. 8, 2019

(65) Prior Publication Data

US 2020/0009450 A1 Jan. 9, 2020

Related U.S. Application Data

(60) Provisional application No. 62/694,642, filed on Jul. 6, 2018.

(51) Int. Cl.

| | |
|---|---|
| ***A63F 9/20*** | (2006.01) |
| ***A63F 3/00*** | (2006.01) |
| *A63F 7/00* | (2006.01) |

(52) U.S. Cl.

CPC ..... *A63F 3/0052* (2013.01); *A63F 3/0023* (2013.01); *A63F 3/00261* (2013.01); *A63F 3/00075* (2013.01); *A63F 9/20* (2013.01); *A63F 2003/0087* (2013.01); *A63F 2003/0088* (2013.01); *A63F 2003/00476* (2013.01); *A63F 2003/00772* (2013.01); *A63F 2003/00779* (2013.01); *A63F 2003/00845* (2013.01); *A63F 2003/00858* (2013.01); *A63F 2003/00867* (2013.01); *A63F 2003/00883* (2013.01); *A63F 2007/0041* (2013.01)

(58) Field of Classification Search

CPC .... A63F 2003/00883; A63F 2003/0088; A63F 2003/0087; A63F 2003/00867; A63F 2003/00845; A63F 2003/00858; A63F 2003/00779; A63F 2003/00772; A63F 3/00075; A63F 9/20

USPC ..... 273/262, 242, 264, 271, 275, 288, 291, 273/292, 293, 294

See application file for complete search history.

(56) References Cited

U.S. PATENT DOCUMENTS

| | | | | |
|---|---|---|---|---|
| 4,067,577 A * | 1/1978 | Minty, Jr. | ..... | A63F 3/00697 273/275 |
| 4,411,433 A * | 10/1983 | Flynn | ..... | A63F 3/00574 273/260 |
| 4,527,800 A * | 7/1985 | Samansky | ..... | A63F 3/0023 273/261 |
| 5,662,332 A | 9/1997 | Garfield | | |
| 7,347,422 B1 * | 3/2008 | Wadowski | ..... | A63F 3/00697 273/236 |

(Continued)

*Primary Examiner* — Benjamin Layno
(74) *Attorney, Agent, or Firm* — Lewis Rice LLC

(57) ABSTRACT

Apparatus and methods for playing an orientation-based tabletop game in which one or more game components have functions that vary depending on the orientation of the game component on the game board as compared to the physical location of player positions around the game board. As pieces rotate during the course of play, functional indicators on the game pieces alter the rules or functions of the game piece in the game with respect to each player, depending upon the orientation of the game piece in relation to each player.

20 Claims, 2 Drawing Sheets

(56) References Cited

U.S. PATENT DOCUMENTS

| | | | | |
|---|---|---|---|---|
| 2003/0047873 | A1* | 3/2003 | Brown | A63F 3/02 273/288 |
| 2017/0348591 | A1* | 12/2017 | Murthy | A63F 9/0669 |
| 2018/0147481 | A1* | 5/2018 | Abraham | A63F 1/04 |

* cited by examiner

ORIENTATION DEPENDENT TOKEN AND METHOD FOR PLAYING A GAME THEREWITH

CROSS-REFERENCE TO RELATED APPLICATIONS

This application claims the benefit of U.S. Prov. Pat. App. No. 62/694,642, filed Jul. 6, 2018, the entire disclosure of which is incorporated herein by reference.

BACKGROUND OF THE INVENTION

Field of the Invention

This disclosure is related to the field of board games and puzzles, and more particularly to methods for playing a game in which the orientation of the game elements on a surface alters the functional characteristics of the game elements both to other game elements and to the players.

Description of the Related Art

Board games have a long and storied history in most human cultures. Archeologists have discovered artifacts of humanity's interest in games going back thousands of years. The widely played game backgammon, for example, is believed to have originated in ancient Persia more than 5 millennia ago.

Board games are a subset of a wider category of games known as "tabletop games," which include classical card games, such as poker and gin rummy, as well as more complex games, such as roleplaying games and miniature war games. Many tabletop games rely on commonly used elements arranged in new and interesting combinations. Such elements include, but are not limited to, the use of randomness to introduce an element of luck and unpredictability into the game. This may be through use of a random number generator, such as dice or a spinner, or through the use of randomized access to resources and game elements, such as by shuffling a deck of cards.

Another common element is the use of a play surface on which game elements are disposed. This is useful in providing all players with an instant visual representation of the state of the game. This play surface often includes graphical elements, such as a map or path, that may be traversed or otherwise utilized by game pieces in accordance with the game rules. For example, the popular game Monopoly™ features a continuous square path around the perimeter of a board. In another example, chess and checkers are played on an 8×8 grid of alternatingly shaded squares.

Another common element is incomplete information. Some games allow each player full access to all information about the game state, such as chess. Others allow the player to know most information about the game state, but nevertheless introduce an element of randomness through hidden information. For example, in Monopoly™, the overall game state is clear on the board, but the order of cards in the shuffled decks of Chance and Community Chest cards is unknown. Still other games are highly reliant on secrecy and incomplete information. For example, in virtually all variants of poker, each player has at least some "pocket" cards that are visible only to that player, and to no one else.

Traditionally, games are played around a table or other shared surface. However, this is not done because game play mechanics require it. Rather, it is a matter of convenience. For example, when playing a game of poker, each player keeps his or her pocket cards secret, and positioning each player around a table minimizes peeking. However, this is not required, and in larger poker tournaments, it is common for 10 players to play elbow-to-elbow at a single table, carefully examine their pocket cards, memorize them, and then leave those cards face-down on the table during play. However, the actual rules of the game, and the outcome of its play, do not change based on how the cards or players are oriented with respect to the poker table.

Many games include an aspect of "piece control"—that is, which player is authorized under the game rules to manipulate certain game pieces. This control is usually visually indicated in the design of the game piece itself. In chess, for example, each player controls 16 game pieces, all the game pieces in a given 16-piece set are the same color, but each of the players' sets are a different color, usually "white" and "black" to make the chess board easier to read during the dense middle game. Other games indicate control through shape. For example, in Monopoly™, each player selects a token having a particular shape (dog, train, hat, car, etc.), and simply remembers which shape he or she has chosen. More advanced tactical games, also use this basic concept. In the World War II simulation Axes and Allies™, for example, each nation's military units are molded to the same shape, but in different colors. However, in tabletop roleplaying games, like Dungeons and Dragons™, players often purchase an unpainted model and paint it themselves. Similar to Monopoly™, each player simply remembers which piece is his or hers, using the visual design as the indication of ownership or control.

Another common aspect of games is that interactions between pieces depend on positioning on the game board. For example, in chess, each piece has a defined set of permitted moves. The rook, for example, can move along ranks and files, but cannot move diagonally. Similarly, the position of a knight on the chessboard, as well as the positions of other pieces on the board, limits the other spaces to which the knight can move. However, the orientation of the knight (typically represented as a horse) is irrelevant. The direction in which the horse faces on the board is irrelevant to where the knight can move, how it interacts with other pieces on the board, or how it interacts with the players.

Other tabletop games do use piece orientation for various purposes. For example, in the card game Magic: the Gathering™, the specific position of a player's cards does not have any impact on the game, but the player indicates that he or she is using or "tapping" certain cards during the turn by rotating them horizontally. This may be contrasted with poker, where the orientation of the cards is irrelevant. Orientation may also define how pieces can interact. For example, in the tile-based game Carcassone™, each player takes turns playing a "terrain" tile with visual indications of game play elements, such as rivers, roads, and city walls. These elements must align properly with all adjacent cards, which means that a given tile may be playable in a given position in some orientations, but not others. However, in all of these cases, the orientation of the game piece does not alter the control or ownership aspect of the game piece.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is an orientation-based entertainment system comprising: a play surface having a first region, a second region adjacent the first region, and having a first player position and a second player position; a first game component disposed in the first region in a first orientation and comprising: a first orientation surface and a first functional indicator disposed on the first game component proximate the first orientation surface; a second orientation surface and a second functional indicator disposed on the first game component proximate the second orientation surface, the second orientation surface facing a different direction than the first orientation surface; and a second game component disposed in the second region; wherein in the first orientation: the first orientation surface is facing the first player position and the second orientation surface is facing the second game component; the first functional indicator defines a functional game relationship between the first player position and the first game component; and the second functional indicator defines a functional game relationship between the first game component and the second game component; wherein when the first game component is rotated in the first region to a second orientation in which the first orientation surface is facing the second player position and the second orientation surface is not facing the second game component: the first functional indicator does not define the functional game relationship between the first player position and the first game component; the first functional indicator defines a functional game relationship between the second player position and the first game component, the functional game relationship between the second player position and the first game component being the same functional game relationship as the functional game relationship between the first player position and the first game component; and the second orientation surface does not define the functional game relationship between the first game component and the second game component.

In an embodiment, the play surface is in the configuration of a rectangular game board.

In an embodiment, the system comprises a puzzle.

In an embodiment, the system comprises a board game.

In an embodiment, wherein the first region and the second region are in the configuration of a square.

In a further embodiment, the first game component is the configuration of a rectangular prism having a top side and an opposing bottom side, and four lateral sides extending between the top side and the bottom side, a first lateral side of the four lateral sides comprising the first orientation surface and a second lateral side of the four lateral sides comprising the second orientation surface.

In a further embodiment, the first orientation surface is adjacent the second orientation surface.

In a further embodiment, the first orientation surface is opposite the second orientation surface.

In a further embodiment, the first functional indicator and the second functional indicator are disposed on the top surface.

In a further embodiment, the first functional indicator is disposed on the first orientation surface and the second functional indictor is disposed on the second orientation surface.

Also described herein, among other things, is a method for playing an orientation-based entertainment system comprising: providing an orientation-based entertainment system comprising: a play surface having a first region, a second region adjacent the first region, and having a first player position and a second player position; a first game component comprising: a first orientation surface and a first functional indicator disposed on the first game component proximate the first orientation surface; a second orientation surface and a second functional indicator disposed on the first game component proximate the second orientation surface, the second orientation surface facing a different direction than the first orientation surface; and a second game component disposed in the second region; disposing the first game component in the first region in a first orientation in which the first orientation surface is facing the first player position and the second orientation surface is facing the second game component; in the first orientation: the first functional indicator defining a functional game relationship between the first player position and the first game component; and the second functional indicator defining a functional game relationship between the first game component and the second game component; rotating the first game component disposed in the first region to a second orientation in which the first orientation surface is facing the second player position and the second orientation surface is not facing the second game component; in the second orientation: the first functional indicator not defining the functional game relationship between the first player position and the first game component; the first functional indicator defining a functional game relationship between the second player position and the first game component, the functional game relationship between the second player position and the first game component being the same functional game relationship as the functional game relationship between the first player position and the first game component; and the second orientation surface not defining the functional game relationship between the first game component and the second game component.

In an embodiment, the play surface is in the configuration of a rectangular game board.

In an embodiment, the play surface comprises a puzzle.

In an embodiment, the play surface comprises a board game.

In an embodiment, the first region and the second region are in the configuration of a square.

In a further, the first game component is the configuration of a rectangular prism having a top side and an opposing bottom side, and four lateral sides extending between the top side and the bottom side, a first lateral side of the four lateral sides comprising the first orientation surface and a second lateral side of the four lateral sides comprising the second orientation surface.

In a further, the first orientation surface is adjacent the second orientation surface.

In a further, the first orientation surface is opposite the second orientation surface.

In a further, the first functional indicator and the second functional indicator are disposed on the top surface.

In a further embodiment, the first functional indicator is disposed on the first orientation surface and the second functional indictor is disposed on the second orientation surface.

DESCRIPTION OF THE PREFERRED EMBODIMENT(S)

Figure 1:
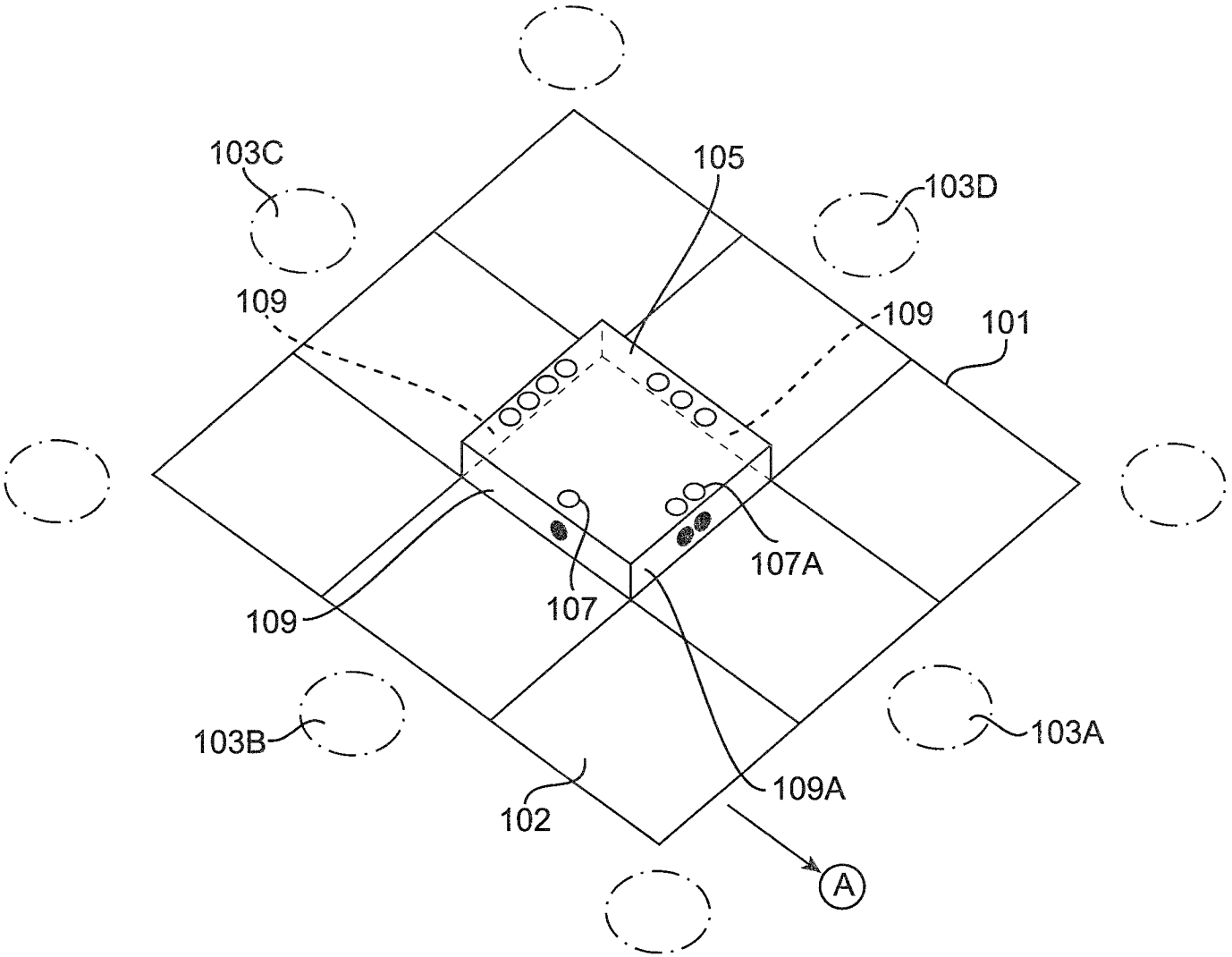
FIG. 1 depicts an embodiment of an orientation-based game component disposed on an orientation-based play surface according to the present disclosure.

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Described herein, among other things, are methods for playing a playable tabletop game or in the solving of a physical puzzle device in which one or more components are orientation-based. As used herein, the term "orientation-based" game element refers to a physical element of a playable game such as a token, card, or other game piece which is designed such that the physical orientation of the game element relative a play surface, and not just its position on the play surface, bears a functional relationship to the element's interactions with other game elements and human players.

For ease of discussion, throughout this disclosure a game element will be referred to as having two different aspects of its positioning relative to the play surface. The first aspect is its "position." Position refers to where on the surface the game element is placed. To use as a simple example, a token on "Boardwalk" in Monopoly™ is in a different position to a token on "Reading Railroad." Similarly, a token located on "Chance" between "Vermont Avenue" and "Oriental Avenue" is at a different position to a token located on "Chance" between "Indiana Avenue" and "Kentucky Avenue." In this later example, the position is different even though the play effect of those two different positions is the same. It is important to keep in mind that the position of a game element on a board often provides for a game effect. Keeping with the same example, a token moving to "Chance" means the player draws a Chance card.

The second aspect of the game element is its "orientation." The orientation of an element is its orientation relative to the rest of the game board regardless of position. Thus, in Monopoly™ if the token is the scotty dog, the dog standing on "Boardwalk" facing toward "Go" is in different orientation to the scotty dog standing on "Boardwalk" and facing "Luxury Tax." Similarly, if the scotty dog was placed upside down (its legs pointing upward), that is a different orientation to it standing (its legs facing downward), which is a different orientation to it laying on its side. As should be apparent to anyone familiar with the rules of Monopoly™ the orientation of the token is irrelevant to game play and some tokens have fewer distinct orientations (e.g. the top hat or thimble) compared to others (e.g. the scotty dog or car).

The game element will also be considered to have two different interactions as part of game play. The first of these interactions is with a player. Typically, a player will interact with only a subset of game elements which are on the board but each player will interact with at least some subset, and there may be overlap between players and subsets they interact with. For example, in Monopoly™ each player has a specific token which is their avatar and represents "their" position on the game board. Traditionally, the player to which a game element belongs is indicated by the element's appearance typically with either each player having a single token with unique appearance or a small set of tokens with a common element. The common element is often color such as is the case with chess pieces.

The other interaction of a game element is with other game elements. While interaction between tokens is typically for those in specific positions, interaction between game elements is different from position as the elements interact with each other and not with the board or surface.

A simple example of an interaction with game elements is that a rook placed in the same column as a pawn may move to the pawns square "taking" the pawn out of the game. This interaction occurs regardless of the position of either piece so long as they are in the same column. Further, the interaction in this case, only occurs when the rook moves to the pawn's square as that causes the piece to be taken. Simply because the rook can take the pawn does not create an interaction as the player could choose not to take the pawn (maybe take a knight instead) which creates either no piece interaction or a different piece interaction.

Throughout this disclosure, the term "game element" or "game component" is used to refer to a token, piece, or other object which is moved and positioned relative to a game board or play surface. As such, the element is typically "in play." The best example of this is that a chess piece on the grid of a chess board is part of the game while a piece that has been previously taken and removed from the board has no bearing on the game at all.

Finally, while the discussion herein refers primarily to a game or play system, it should be recognized that the game play can be performed by a single player which often makes the system more akin to a puzzle than a game. However, these two modes of operation are both referred to herein typically as a game or as game play.

FIG. 1 depicts a play surface (101) adapted to facilitate orientation-based game play. The depicted play surface (101) is a generally planar, rigid structure generally in the nature of a game board. While a conventional board is depicted, the specific configuration and appearance of the play surface (101) may vary substantially from embodiment to embodiment depending upon various considerations, such as overall game design, rules, and theme. By way of example and not limitation, the play surface (101) may have an irregular or non-polygonal shape, or may be or comprise three-dimensional elements, mechanical elements, recesses, raised portions, and so forth.

The depicted play surface (101) is subdivided into a plurality of regions (102). A region is a physically distinct, separable, and identifiable sub-element of the play surface (101), adapted to receive or accommodate a game component (105) in a pre-determined orientation. For sake of clarity, these regions (102) may also be referred to as game component regions. In the depicted embodiment, the regions (102) comprise a plurality of squares arranged in a 3×3 grid. This is because the depicted regions (102) are adapted to accommodate the depicted game component (105).

However, the specific configuration and appearance of the regions (102) may vary substantially from embodiment to embodiment depending upon various considerations, such as overall game design, rules, and theme. By way of example and not limitation, the regions (102) may have an irregular or non-polygonal shape, or may be or comprise three-dimensional elements, mechanical elements, recesses, raised portions, and so forth. The regions may be all the same shape or size, or may differ from one another in accordance with the needs of any particular game embodiment. A region (102) typically is used in game play in that a game element placed in a specific region (102) is typically considered to be in the same position as a second game element also placed in that specific region (102) regardless of if the pieces are on top of each other, beside each other, etc.

Each region (102) is adapted to receive or accommodate one or more orientation-based game components from a plurality of game components (105). An orientation-based game component is a component of the game having an orientation-based function. That is, the interaction of the game component (105) with both player(s) and other game elements has a functional relationship to the orientation of the game component (105) on the play surface (101). In the depicted embodiment, the game component (105) is shown as a small rectangular block or prism having 8 sides. The four lateral sides (109) are orientation surfaces (109), meaning the orientation of these surfaces (109) with respect to the play surface (101) bears a functional relationship to the component's (105) interaction with players or other game elements.

In the depicted embodiment, the game component (105) has four orientations and may be positioned in any of at least four orientations in any region (102). Thus, a single game component (105) in FIG. 1 has nine possible positions. Further, within each position, the single game component has at least four possible orientations (one each for aligning each of the four surfaces (109) with each side of the region (102) it is positioned in). There may be additional orientations available such as by flipping the game component (105) over or standing it on edge. However, for purposes of this disclosure, the play here will assume that the component (105) is supposed to remain flat simply to keep the number of possible interactions manageable for discussion purposes only. Thus, in this embodiment, the game element has 36 possible orientation/position combinations.

The game surface (101) here is also provided with game players. These are typically humans positioned around the surface (101) and specifically one is provided to be positioned at the various edges of the board (101). Thus, there could be anything from one to four players arranged at the board. In the depicted orientation, a first orientation surface (109A) is oriented towards a first player position (103A) adjacent to an edge of the game play surface (101). However, if the depicted game component (105) were rotated clockwise by 90 degrees, the first orientation surface (109A) would instead be oriented towards a second player position (103B), and a second orientation surface (109D) would be oriented towards the first player position (103A). Likewise, if the game component (105) were rotated another 90 degrees, the first orientation surface (109A) would be oriented towards a third player position (103C), and so forth through all four possible orientations of the game component (105).

It will be clear that the present disclosure is not limited to four orientations and four player positions. For example, a pentagonal or hexagonal game component could be used, which has five or six orientations, respectively. Additionally, it is not required that there be a 1:1 correspondence between the number of orientation positions for a game component and the number of player positions. For example, in the depicted embodiment of FIG. 1, there are four orientations for the square-shaped game component (105), and there are four player positions (103A), (103B), (103C), and (103D) at the edges of the depicted play surface (101). In each possible orientation of the game component (105) on the play surface (101), each orientation surface (109) is oriented to a different player position (103). However, additional player positions (105) could be added, such as at the corners, which do not correspond to any orientation surface (109) in any orientation. Alternatively, in an embodiment, some player positions (103) could have a corresponding orientation surface for some orientations of a game component (105), but not others. The possibilities are limitless and the particulars in any given embodiment will depend on game rules and design, among other considerations. For the purpose of this disclosure, it simply needs to be the case that the orientation of the element (105) on the surface (101) will indicate a particular player or player effect.

In the depicted embodiment of FIG. 1, the game component (105) is a rectangular prism, but the specific configuration and appearance of each game component (105) may vary substantially from embodiment to embodiment, or within an embodiment, depending upon considerations such as overall game design, rules, and theme. Similarly, in the depicted embodiment, the orientation surfaces (109) are rectangular faces of the prism, but this is again a design choice based upon on the game design of the depicted embodiment.

In an alternative embodiment, for example, the orientation surface (109) need not be a face of a polygon, but may instead be a side of a card or sub-region of a three-dimensional model, such as vehicle or miniature. By way of example and not limitation, in a game based on an "Old West" theme, the game component (105) may be a miniature figurine of a cowboy holding a drawn pistol. In this embodiment, there may be only one "orientation surface" (109) for the three-dimensional figurine—the direction in which the pistol is pointed.

Thus, it follows that even in the depicted embodiment, it is not necessary that all four sides of the game play element (105) be orientation surfaces (109). For example, it is possible that only one, two, or three of the lateral sides of the depicted game play element (105) are orientation surfaces (109), and the others have no function.

In the depicted embodiment of FIG. 1, each of the orientation surfaces (109) comprises a function indicator (107). In the depicted embodiment, the function indicator (107) is a set of dots disposed on the orientation surface (109) itself, and shown again on the top of the game component (105) at an edge adjacent to each orientation surface (109). The purpose of the indicator (107) is to indicate the function of the orientation surface (109) in a given orientation. For example, returning to the cowboy example above, the indicator would be the pistol itself, which can be visually detected as pointed in a given orientation. While it is typical that each orientation surface (109) will have at least one indicator (107), it is not necessary. The nature of the indicator (107) may vary substantially from embodiment to embodiment, or within an embodiment, depending upon considerations such as overall game design, rules, and theme.

An element of the present disclosure is that during game play, the orientation of the game component (105) on the play surface (101) bears a functional relationship to the interaction of the game component (105) with other game elements (105) and players outside of the positioning of the game component (105) on the play surface (101) or specifics of the game component (105) itself, such as color. The precise nature of the interaction will vary from embodiment to embodiment depending on the nature of the game and game rules. For purposes of the present disclosure, regardless of the specific relationship, the orientation of the game component (105) determines a relationship either alone or in combination with other aspects such as position and non-orientation token (105) appearance (e.g. what the token depicts or its color scheme).

Figure 2:
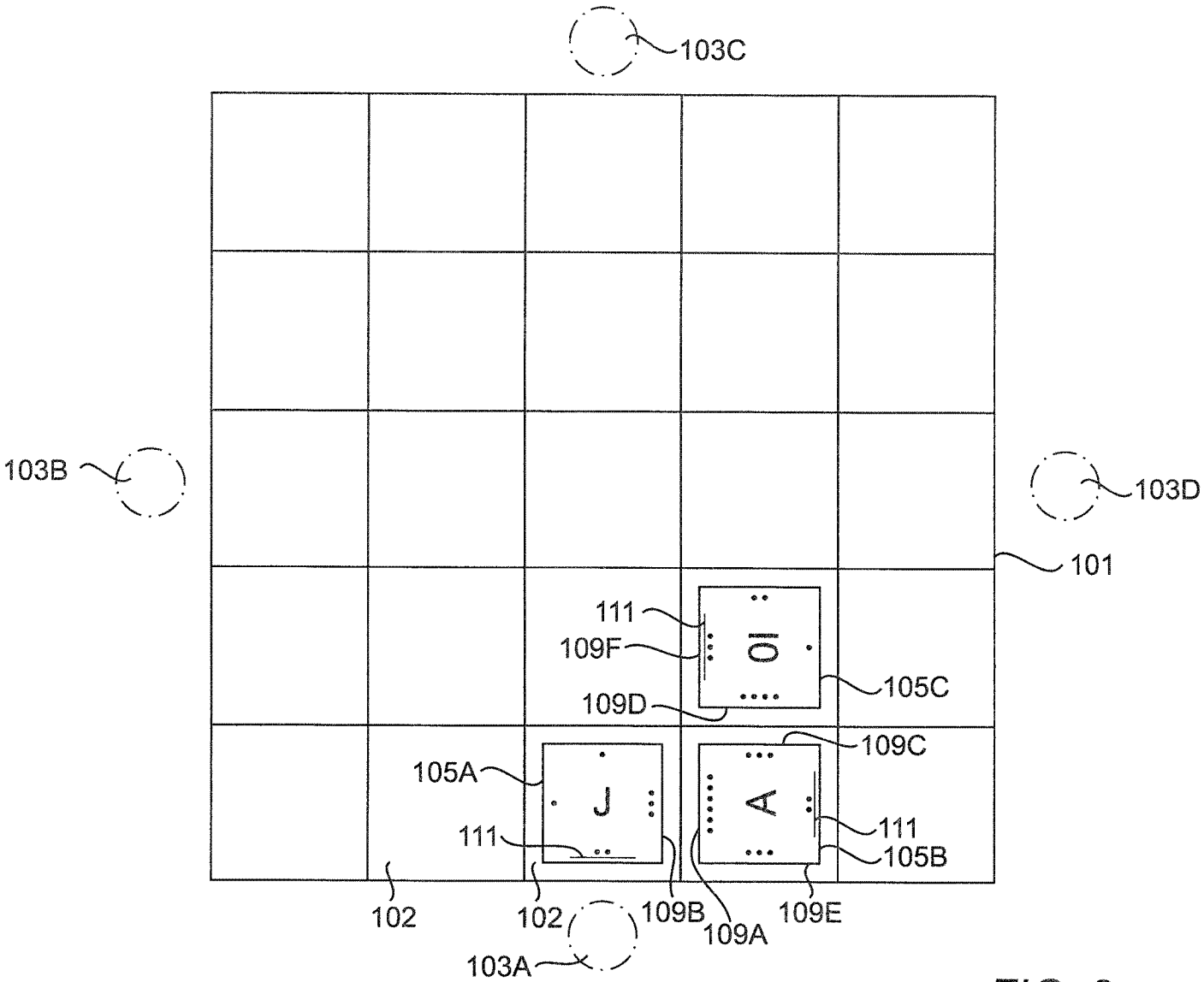
FIG. 2 depicts an alternative embodiment of an orientation-based game component disposed on an orientation-based play surface according to the present disclosure.

FIG. 2 depicts another embodiment of a game surface (101) and components (105) in which the play surface (101) comprises a 5×5 grid of squares (102) adapted to receive a game component (105A), (105B), and (105C) in the configuration of quadrilateral playing card (105A), (105B), and (105C). Each of the depicted playing cards (105A), (105B), and (105C) has four orientation surfaces, and each orientation surface has a corresponding indicator disposed on the top of the card adjacent to the orientation surface. The depicted indicators are generally sets of dots. Each depicted card playing card (105A), (105B), and (105C) also has one orientation surface with a second indicator in the form of a horizontal line (111). Thus, in any embodiment, a given orientation surface may serve multiple functions, each function indicated by a separate indicator.

In the depicted embodiment, the cards (105A), (105B), and (105C) may be moved to interact with one another, and the nature of the functional relationship is the resolution of that interaction. For example, suppose a first card (105B) has just moved to the position it currently occupies adjacent the space of a second card (105A). In the depicted embodiment, the number of dots on the orientation surface (109A) of the first card (105B) oriented towards the second card (105A) is compared to the number of dots on the orientation surface (109B) of the second card (105A) oriented towards the first card (105B). Because the first card (105B) has more dots on the relevant orientation surface (109A), it "wins" the interaction and the second card (105A) is removed from the game.

However, following the same example, the first card (105B) also moved to occupy a space adjacent the third card (105C), and a different outcome may result because the number of dots on the orientation surface (109C) oriented towards the third card (105C) is less than the number of dots on the orientation surface (109D) of the third card (105C) oriented towards the first card (105B). Thus, if this move is made, the first card (105B) may instead or additionally be removed.

As can be seen, if a game component (105A), (105B), and (105C) is rotated to a second orientation, the results of the interactions between the components (105A), (105B), and (105C) may change. For example, if the first card (105B) were rotated 90 degrees clockwise, it (105B) would have more dots indicated on the orientation surface (109A) now facing the third card (105C), but a tie with the orientation surface (109E) facing the second card (105A).

The specific result of the interaction is not material; the point is that the orientation of the game component (105) is relevant to interactions among the elements. This is a stark contrast with conventional board games, where the orientation of the game pieces is not relevant. For example, in conventional games like Monopoly™, it does not matter how each player piece is oriented on the board. However, in the present case, the game play does not end there. Games exist, for example miniature wargames, where the orientation between elements provides an interaction between elements. For example, in games which use a tokens "line of sight" to determine which other to tokens they can "shoot at" to attempt to remove.

In an embodiment, the nature of the interactions is also based upon the orientation of a game component with respect to a player position. That is, a game component having a given orientation on the play surface has a different functional relationships to each player, the relationships being defined or determined at least in part on the basis of the orientation of the game component with respect to the physical position of the player with respect to the play surface. By extension, the rotation of a game component may alter its relationship to each player because the orientation of the game component with respect to each player position has changed.

For example, the game rules may provide that a given game component is always oriented such that its front faces the player whose turn it is. Thus, when play passes to another player having a different player position than the prior player, the game component is physically rotated such that its front faces the new active player. By way of further example, the sides of the game piece may have other attendant rules, such as that which players are in positions facing the sides receive a penalty or bonus, or game components controlled by those players receive penalties or bonuses. Thus, when the active player makes choices about game strategy, he or she must consider that the rotating game piece will turn to the next player, and this will changes its functional role in the game.

By way of further example, ownership and/or control of a game component may be based at least in part on orientation. For example, suppose the rules provide that a game component is controlled only by the player that the game component faces. That player may have advantageous options for manipulating the game component, but which would cause the orientation to change such that the player loses control of the game component thereafter. By contrast, a game component may have deleterious effects to the owner, and, thus, the controlling player is motivated to rotate the piece to be oriented towards a different player to apply a penalty to that player.

Applying this second example to the illustrative game play example described with respect to FIG. 2 shows the operation. In this case, the line (111) indicates the player position (103A), (103B), (103C), or (103D) that controls the component (105A), (105B), or (105C). Thus, component (105C) is controlled by player (103B), component (105B) is controlled by player (103D), and component (105A) is controlled by player (103A). However, let us assume that prior to the immediate positioning, the game components (105A), (105B), and (105C) were controlled by the same player in position (103A). Thus, the game components (105A), (105B), and (105C) would all be oriented with their line (111) toward the bottom of FIG. 2 and since they are co-owned there is no interaction even though side (109A) of component (105B) has more dots than side (109F) of game component (105C) and is indicated as stronger (side (109E) and side (109B) happen to be equal)). There is no threat and no interaction takes place because both components are controlled by the same player (103A).

However, during player's (103B) turn something can occur (e.g. the playing of a card) whereby the player rotates the game components (105C) and (105B) to the indicated positions of FIG. 2. According to the game rules, this causes control over game component (105C) to change from player (103A) to player (103B) and component (105B) to change to player (103D). Because the ownership of the components (105C) and (105B) has changed, but the ownership of component (105A) has not, the interaction between elements now differs due to the change in control. Specifically, player (103B) gains control of game component (105C) which now takes (removes from play) adjacent component (105B) and game component (105B) takes (removes from play) game component (105A) due to the dot interaction.

Thus, the player in position (103B) used the orientation mechanic to simultaneously alter control of two game components (even though they only gained control of one), created the circumstances for a game play interaction not permitted prior to the change in orientation, and altered the strategic relationship of all the pieces and who controls the board. Without changing position of any piece, the change in orientation altered the pieces on the board and changed the control of the remaining pieces in a single action. Again, the nature of the specific interaction is not the point, but rather that the orientation of the game component is relevant to control, and by extension, interactions with other elements and players.

Thus, in an embodiment, a change in orientation of a game piece has a corresponding and simultaneous impact on which player controls the pieces in question, and how that piece interacts with other pieces. It is important to understand that this differs from a mere change in position which can cause the interaction. For example, this differs from a game such as poker, which has no orientation element. A player simply "controls" the cards in the pocket placed before him, regardless of how the cards are oriented. This also differs from a game such as Monopoly™ where the orientation of the player's token on the board is immaterial; regardless of what direction the car token faces in its square, the same player controls it. This also differs from a game like Magic: the Gathering™, which does have an orientation component in that "tapped" mana cards are turned sideways, but doing so does not alter the ownership or control of that card by its orientation (however, if it was to become positioned in front of the other player that could alter control).

This also differs from strategy games that have orientation elements. For example, in a tactical or miniature combat-based roleplaying game, the orientation of the piece on the board may matter in certain respects (e.g., which opposing game pieces a given unit may attack using "line of sight" attacks), but this again has no impact on which player owns or controls that game piece as that is based on only on what the piece represents and whose side it began on.

Thus, the systems and methods described herein include disposing a first game component on a play surface having one or more player positions associated therewith, the first game component having a first orientation with respect to one of the player positions, and then changing the orientation of the game component to a second orientation with respect to the one player position, the change in orientation having the effect of changing the game rules in effect as between the first game component and the player. Further, the change in orientation may have the further effect of changing, allowing, or disallowing interactions of the first game component with other game components or players without a change in position. It should be noted that this change is not necessarily limited to a change of ownership or control, but may be or include other changes in game mechanics as well.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. An orientation-based entertainment system comprising:

a play surface having a first region, a second region adjacent said first region, and having a first player position and a second player position;

a first game component disposed in said first region in a first orientation and comprising:

a first orientation surface and a first functional indicator disposed on said first game component proximate said first orientation surface;

a second orientation surface and a second functional indicator disposed on said first game component proximate said second orientation surface, said second orientation surface facing a different direction than said first orientation surface; and a second game component disposed in said second region;

wherein in said first orientation:

said first orientation surface is facing said first player position and said second orientation surface is facing said second game component;

said first functional indicator defines a functional game relationship between said first player position and said first game component; and said second functional indicator defines a functional game relationship between said first game component and said second game component;

wherein when said first game component is rotated in said first region to a second orientation in which said first orientation surface is facing said second player position and said second orientation surface is not facing said second game component:

said first functional indicator does not define said functional game relationship between said first player position and said first game component;

said first functional indicator defines a functional game relationship between said second player position and said first game component, said functional game relationship between said second player position and said first game component being the same functional game relationship as said functional game relationship between said first player position and said first game component; and said second orientation surface does not define said functional game relationship between said first game component and said second game component.

2. The system of claim 1, wherein said play surface is in the configuration of a rectangular game board.

3. The system of claim 1, wherein said system comprises a puzzle.

4. The system of claim 1, wherein said system comprises a board game.

5. The system of claim 1, wherein said first region and said second region are in the configuration of a square.

6. The system of claim 5, wherein said first game component is the configuration of a rectangular prism having a top side and an opposing bottom side, and four lateral sides extending between said top side and said bottom side, a first lateral side of said four lateral sides comprising said first orientation surface and a second lateral side of said four lateral sides comprising said second orientation surface.

7. The system of claim 6, wherein said first orientation surface is adjacent said second orientation surface.

8. The system of claim 6, wherein said first orientation surface is opposite said second orientation surface.

9. The system of claim 6, wherein said first functional indicator and said second functional indicator are disposed on said top surface.

10. The system of claim 6, wherein said first functional indicator is disposed on said first orientation surface and said second functional indictor is disposed on said second orientation surface.

11. A method for playing an orientation-based entertainment system comprising:

providing an orientation-based entertainment system comprising:

a play surface having a first region, a second region adjacent said first region, and having a first player position and a second player position;

a first game component comprising:

a first orientation surface and a first functional indicator disposed on said first game component proximate said first orientation surface;

a second orientation surface and a second functional indicator disposed on said first game component proximate said second orientation surface, said second orientation surface facing a different direction than said first orientation surface; and a second game component disposed in said second region;

disposing said first game component in said first region in a first orientation in which said first orientation surface is facing said first player position and said second orientation surface is facing said second game component;

in said first orientation:

said first functional indicator defining a functional game relationship between said first player position and said first game component; and said second functional indicator defining a functional game relationship between said first game component and said second game component;

rotating said first game component disposed in said first region to a second orientation in which said first orientation surface is facing said second player position and said second orientation surface is not facing said second game component;

in said second orientation:

said first functional indicator not defining said functional game relationship between said first player position and said first game component;

said first functional indicator defining a functional game relationship between said second player position and said first game component, said functional game relationship between said second player position and said first game component being the same functional game relationship as said functional game relationship between said first player position and said first game component; and said second orientation surface not defining said functional game relationship between said first game component and said second game component.

12. The method of claim 11, wherein said play surface is in the configuration of a rectangular game board.

13. The method of claim 11, wherein said system comprises a puzzle.

14. The method of claim 11, wherein said system comprises a board game.

15. The method of claim 14, wherein said first region and said second region are in the configuration of a square.

16. The method of claim 15, wherein said first game component is the configuration of a rectangular prism having a top side and an opposing bottom side, and four lateral sides extending between said top side and said bottom side, a first lateral side of said four lateral sides comprising said first orientation surface and a second lateral side of said four lateral sides comprising said second orientation surface.

17. The method of claim 16, wherein said first orientation surface is adjacent said second orientation surface.

18. The method of claim 16, wherein said first orientation surface is opposite said second orientation surface.

19. The method of claim 16, wherein said first functional indicator and said second functional indicator are disposed on said top surface.

20. The method of claim 16, wherein said first functional indicator is disposed on said first orientation surface and said second functional indictor is disposed on said second orientation surface.

* * * * *